US009587329B2

(12) United States Patent
Choi

(10) Patent No.: US 9,587,329 B2
(45) Date of Patent: Mar. 7, 2017

(54) PROCESS FOR MAKING A POLYMERIC FIBROUS MATERIAL HAVING INCREASED BETA CONTENT

(71) Applicant: Kyung-Ju Choi, Louisville, KY (US)

(72) Inventor: Kyung-Ju Choi, Louisville, KY (US)

( * ) Notice: Subject to any disclaimer, the term of this patent is extended or adjusted under 35 U.S.C. 154(b) by 344 days.

(21) Appl. No.: 14/102,541

(22) Filed: Dec. 11, 2013

(65) Prior Publication Data

US 2015/0159301 A1 Jun. 11, 2015

(51) Int. Cl.

| | |
|---|---|
| ***D01D 5/08*** | (2006.01) |
| ***D01D 5/084*** | (2006.01) |
| ***D01D 5/098*** | (2006.01) |
| ***D01D 5/14*** | (2006.01) |
| ***D01D 7/00*** | (2006.01) |
| ***D01F 1/10*** | (2006.01) |

(52) U.S. Cl.
CPC ..... *D01D 5/0985* (2013.01)

(58) Field of Classification Search
CPC ..... D01D 5/08; D01D 5/084; D01D 5/098; D01D 5/0985; D01D 5/14; D01D 7/00; D01F 1/02; D01F 1/10
USPC ..... 264/210.6, 210.8, 211, 211.12, 211.15, 264/211.17, 555
See application file for complete search history.

(56) References Cited

U.S. PATENT DOCUMENTS 3,959,421 A * 5/1976 Weber ..... D04H 1/565 264/11
4,753,843 A 6/1988 Cook et al.
5,665,278 A * 9/1997 Allen ..... B29C 47/0014 156/167
6,129,879 A * 10/2000 Bersted ..... D02G 3/445 264/211.14 X
6,132,661 A * 10/2000 Kurihara ..... D04H 3/04 264/210.8 X
6,476,135 B1 * 11/2002 Bugada ..... C08L 23/12 525/191
2002/0110610 A1 8/2002 Angadjivand et al.
2006/0141085 A1 6/2006 Nickel et al.
2013/0122771 A1 5/2013 Matsubara et al.

FOREIGN PATENT DOCUMENTS

EP 2599908 6/2013

OTHER PUBLICATIONS

PCT/US2014/067267 International Search Report and Written Opinion, Mar. 13, 2015, Kyunc-Ju Choi.

* cited by examiner

*Primary Examiner* — Leo B Tentoni
(74) *Attorney, Agent, or Firm* — Steve Witters; Witters & Associates

(57) ABSTRACT

A system and process for making a polymeric fibrous material having increased beta content is provided herein. The system is configured for meltblowing polymer into a fibrous material having high beta crystalline content and has an extruder for melting and moving a polymer to a meltblowing die. The meltblowing die has a longitudinally extending die tip with a plurality of spinnerets substantially equidistantly spaced from each other and a longitudinal fluid material flow through passage disposed along each longitudinal side of the die tip configured to axially attenuate the melted polymer from the die tip in fibrous form. A plurality of liquid spray nozzles are configured and disposed to spray a liquid into the fibrous melted polymer attenuated from the die tip.

11 Claims, 9 Drawing Sheets

PROCESS FOR MAKING A POLYMERIC FIBROUS MATERIAL HAVING INCREASED BETA CONTENT

FIELD OF THE DISCLOSURE

This disclosure relates generally to meltblown systems and processes for making a polymeric fibrous material having increased beta content.

BACKGROUND

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Polypropylene (PP) is a thermoplastic polymer used in a wide variety of applications and is the most widely used polymer for meltblown applications. This may be due to its processability, rapid crystallization, and ease of drawing into fine fibers.

Typically, most commercial available polypropylene is mostly isotactic with moderate crystallinity. Crystalline polypropylene is in alpha, beta and gamma crystal forms along with the smectic form in an amorphous state. The triclinic gamma form rarely forms under standard processing conditions. Isotactic PP generally crystallizes into a stable monoclinic alpha form under standard process conditions, sometimes with a very low content of the hexagonal beta form. Typical processes for obtaining an increased content of the beta crystals may include directional crystallization under a temperature gradient, shear induced crystallization, and with the use of specific beta nucleating agents.

The presence of higher levels of beta crystals in meltblown fibrous materials or mat of fibrous materials, may provide the fibrous materials with desired properties. Typical processes used for obtaining an increased content of beta crystals may not be easily adaptable to current meltblown processes or may not provide the fibrous materials with the desired properties.

SUMMARY

In at least one embodiment of the present disclosure, a system is provided. The system is configured for meltblowing polymer into a fibrous material having high beta crystalline content and comprises an extruder configured and disposed to melt a solid polymer and move the melted polymer to a meltblowing die. The meltblowing die is configured and disposed to receive the melted polymer from the extruder and comprises a longitudinally extending die tip having a plurality of spinnerets substantially equidistantly spaced from each other configured to axially attenuate the melted polymer therefrom. A longitudinal fluid material flow through passage is disposed along each longitudinal side of the die tip configured to axially attenuate the melted polymer from the die tip in fibrous form. An insulating material is disposed along each longitudinal side of the die tip. The system further comprising a plurality of liquid spray nozzles configured and disposed to spray a liquid into the fibrous melted polymer attenuated from the die tip, each liquid spray nozzle may comprise at least one of the limitations of a)-d), wherein a)-d) are: a) each liquid spray nozzle having an outlet configured and disposed to spray a substantial amount of liquid at an angle between about 20° and about 85° toward the attenuation axis of the die tip; b) the plurality of liquid spray nozzles being configured to spray at least about 280 cc/min liquid toward the attenuation axis of the die tip; c) each liquid spray nozzle having an outlet axially spaced at most about 7 mm from the die tip; and d) each liquid spray nozzle having an outlet laterally spaced at most about 120 mm from the die tip.

In another aspect of the present disclosure, a process for meltblowing polymer into a fibrous material having high beta crystalline content is provided. The process comprises the steps of: extruding and moving the melted polymer to a meltblowing die; receiving the melted polymer from the extruder with a longitudinally extending die tip; attenuating melted polymer axially from a plurality of spinnerets substantially equidistantly spaced from each other; flowing hot gas through longitudinal fluid material flow through passages along each longitudinal side of the die tip and axially attenuating the melted polymer from the die tip in fibrous form; and spraying a liquid into the fibrous melted polymer attenuated from the die tip. The process comprises at least one of the limitations of a) and b), wherein a) and b) are: a) spraying a substantial amount of the liquid at an angle between about 20° and about 85° toward the attenuation axis of the die tip; and b) spraying at least about 280 cc/min of the liquid toward the attenuation axis of the die tip.

BRIEF DESCRIPTIONS OF THE DRAWINGS

The following figures, which are idealized, are not to scale and are intended to be merely illustrative of aspects of the present disclosure and non-limiting. In the drawings, like elements are depicted by like reference numerals. The drawings are briefly described as follows.

Figure 6:
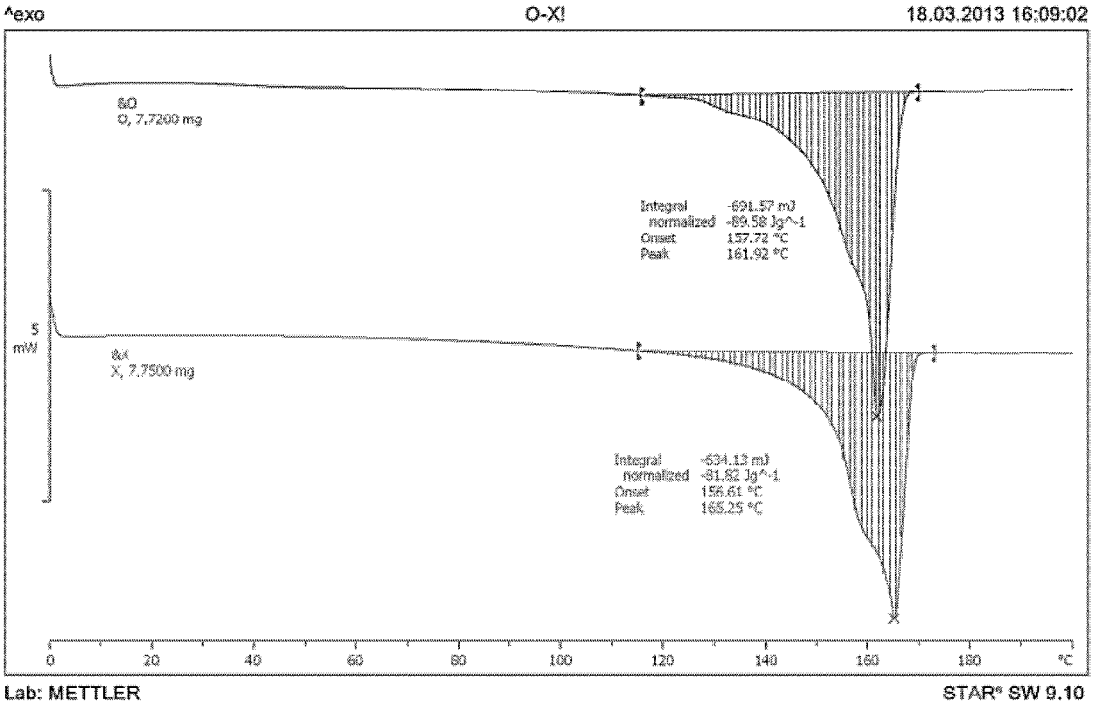
Figure 7:
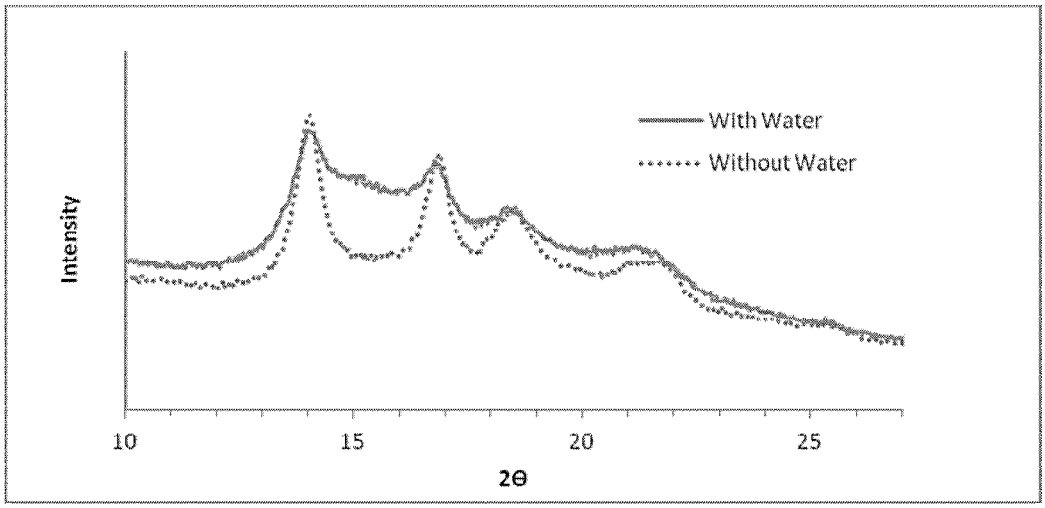
Figure 8:
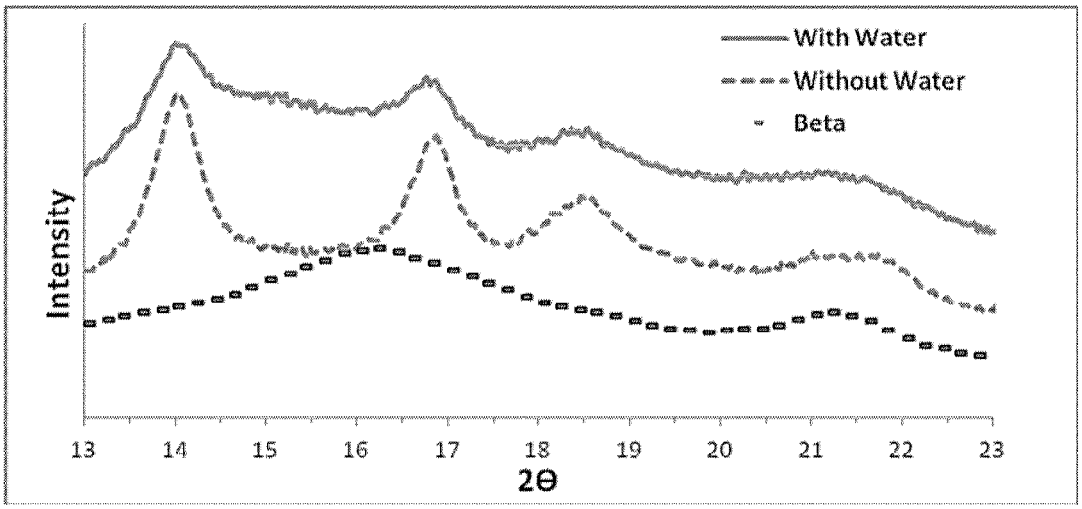
Figure 9:
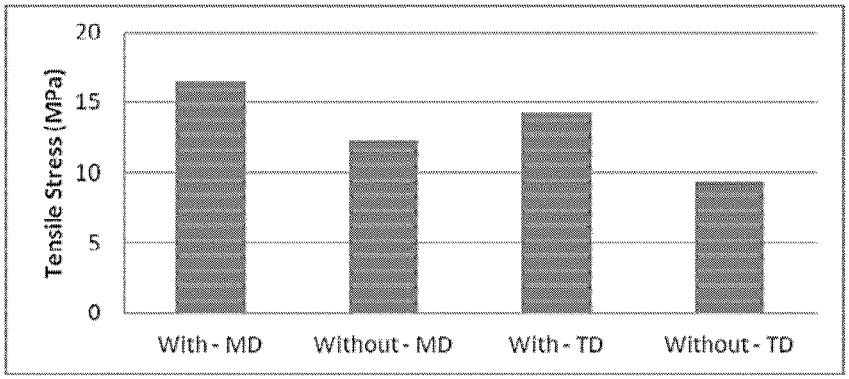
Figure 10:
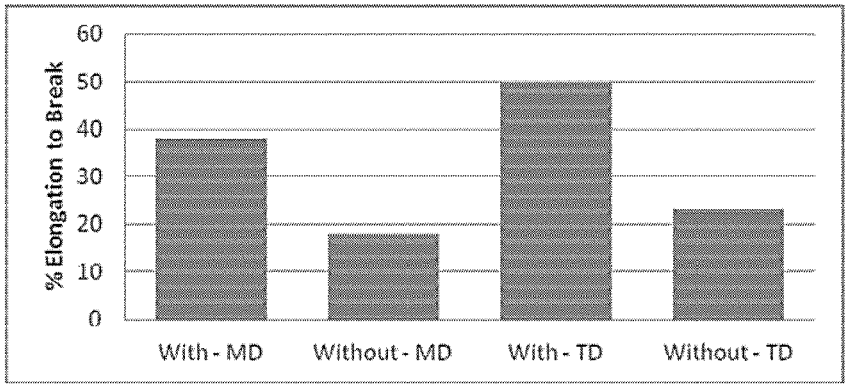
Figure 11:
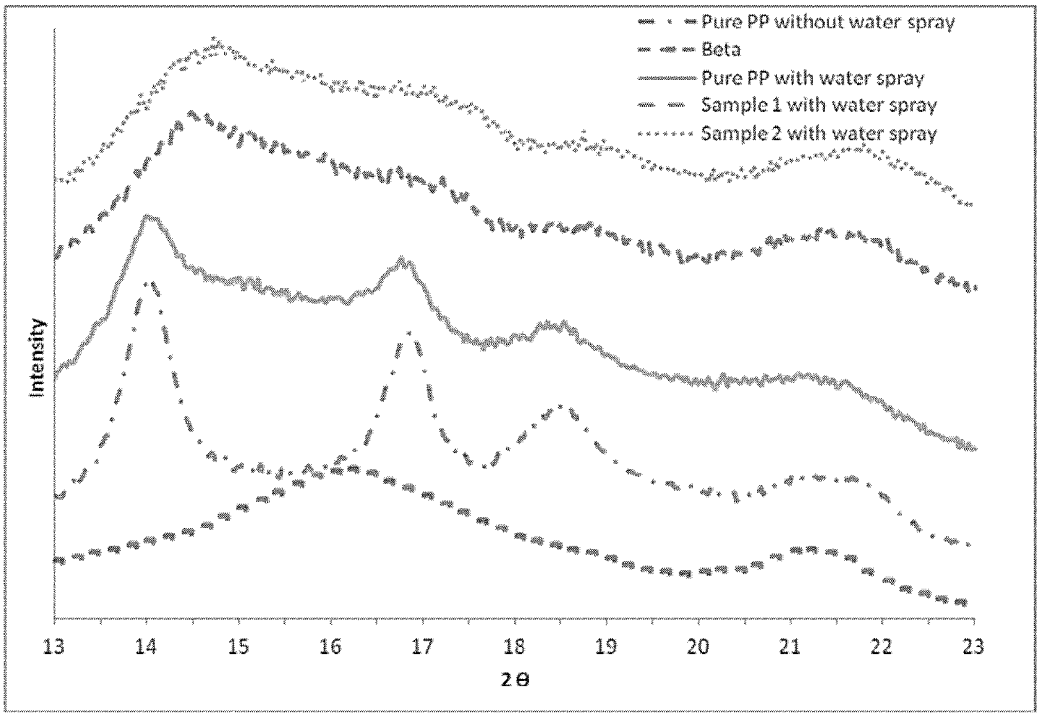
Figure 12:
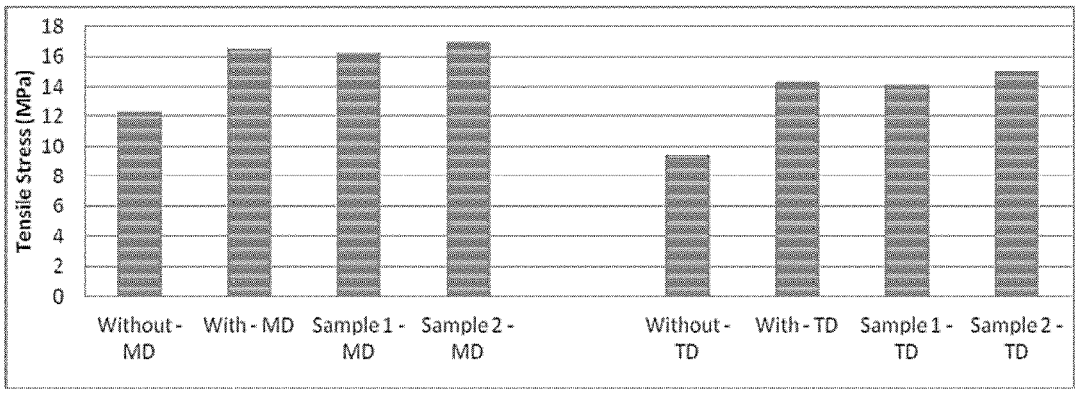
Figure 13:
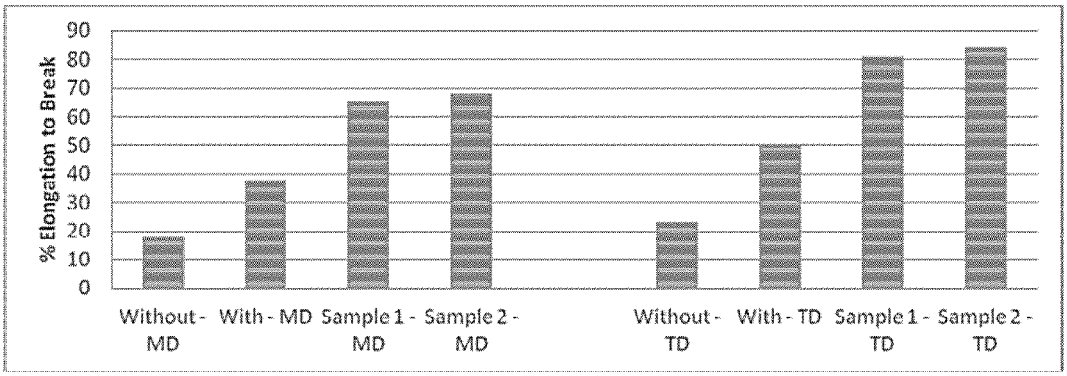

FIG. 6 graphically shows the melting behavior of sample webs with and without water spray;

FIG. 7 graphically shows the WAXS (Wide Angle X-ray Scattering) intensity against 2θ scan for the sample webs with and without water spray;

FIG. 8 graphically shows WAXS 2θ scan of sample webs with and without water spray along with 2θ scan of PP-β form:

FIG. 9 graphically shows tensile stresses of sample webs along the machine direction and the transverse direction;

FIG. 10 graphically shows percent elongation to break of sample webs along the machine direction and the transverse direction;

FIG. 11 graphically shows WAXS 2θ scan of webs of the present disclosure with and without water spray along with 2θ scan of PP-β form:

FIG. 12 graphically shows tensile stresses of webs of the present disclosure along the machine direction and the transverse direction; and FIG. 13 graphically shows percent elongation to break of webs of the present disclosure along the machine direction and the transverse direction.

DETAILED DESCRIPTION

Reference will now be made in detail to the present exemplary embodiments and aspects of the present invention, examples of which are illustrated in the accompanying figures. The present invention relates to a system, process, and apparatus configured for meltblowing polymer into a fibrous material having increased beta content.

Figure 1:
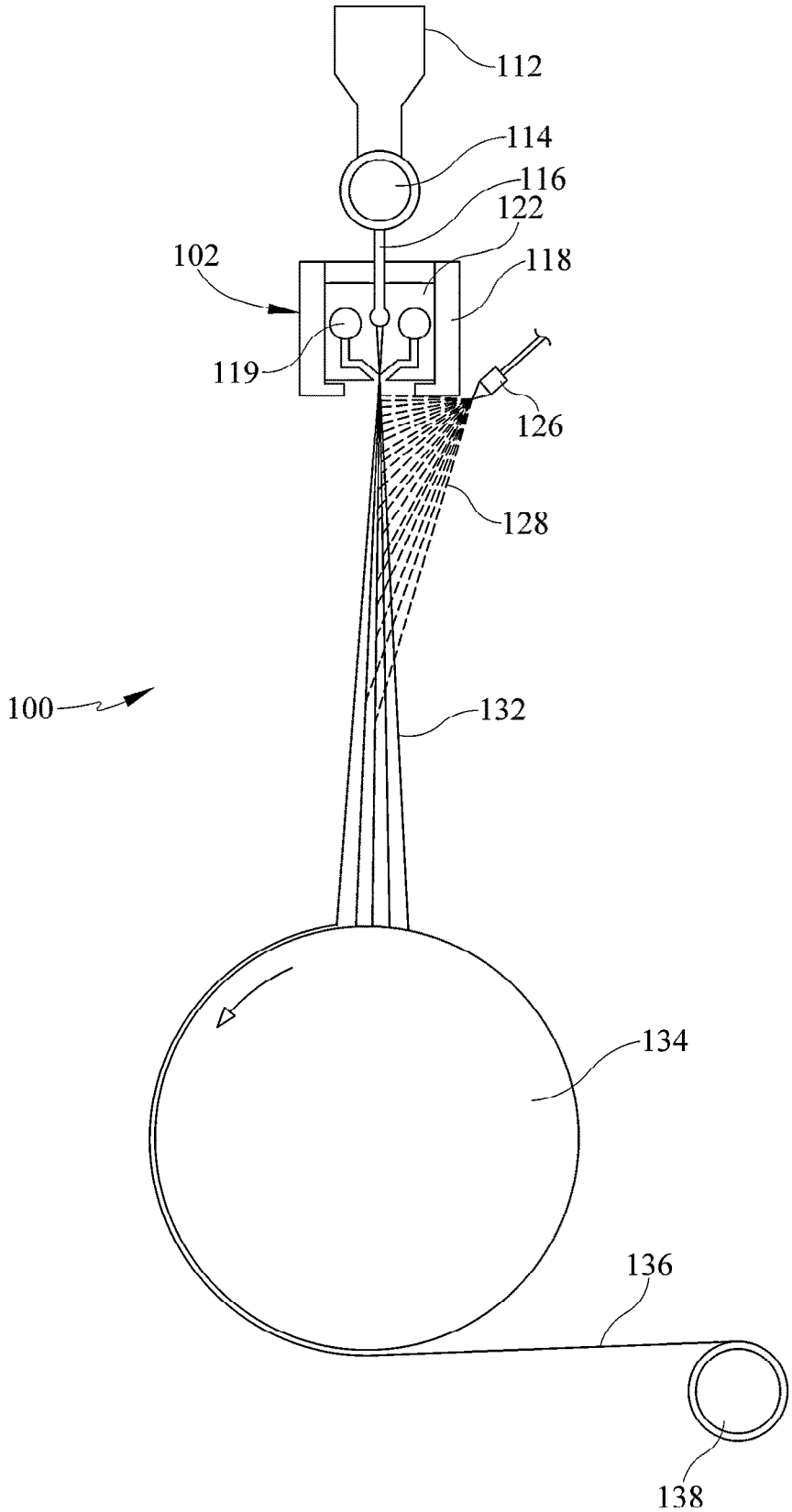
FIG. 1 is a schematic view of a system of the present disclosure showing a melt blown die, a liquid spray nozzle, and a drum collector positioned in spaced relation therebelow to receive and collect melt blown fibrous material having increased beta content.

FIG. 1 shows an embodiment of a system 100 configured for forming non woven fibrous materials having high beta crystalline content. System 100 comprises fluid material feed hopper 112, an extruder 114, which may be a motor driven extruder, fluid material feeder conduit 116, die body 122 and a spaced fibrous web rotating drum collector 134 for collecting fibrous web 136 thereon to be fed to winder 138. System 100 may include either an endless belt type or a drum type collector 134.

Figure 2:
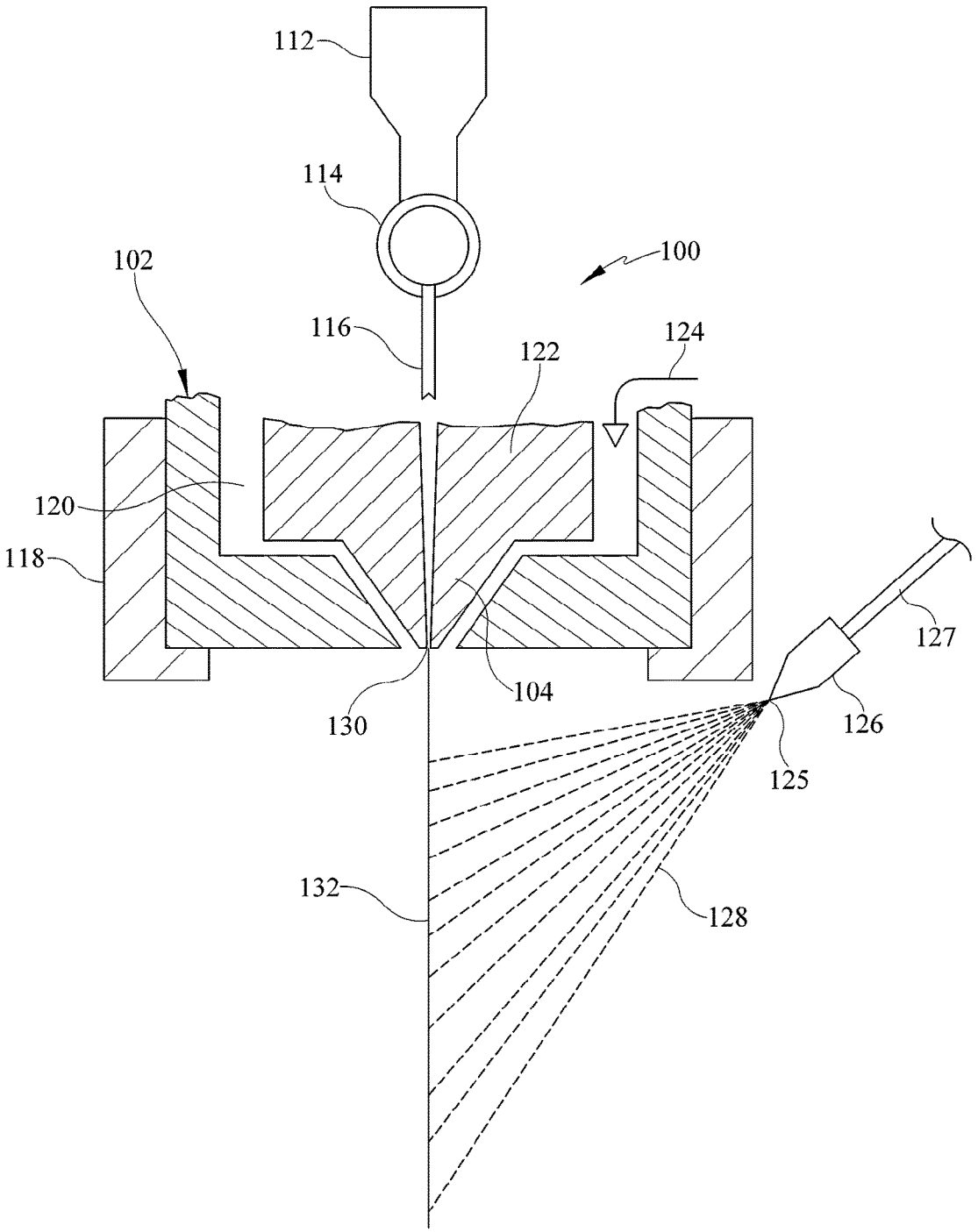
FIG. 2 is a cross-sectional view of a portion of the die of FIG. 1 showing the disposition of the spray nozzles with respect to the system.

Referring to FIGS. 1 and 2 of the schematic drawings, a system 100 for forming non woven fibrous materials having high beta crystalline content into mats using melt blowing dies and melt blowing processes is shown. For example, formation of such a fibrous mat from molten polymers may be made by means of a longitudinally extending die 102 having die body 122.

System 100 may be configured for meltblowing polymer 132 into a fibrous material 136 having high beta crystalline content. System 100 may comprise extruder 114 configured and disposed to melt a solid polymer and move the melted polymer to meltblowing die 102. Meltblowing die 102 may be configured and disposed to receive the melted polymer from extruder 114, which may be configured and disposed to receive solid or granular polymer from hopper 112.

The attenuated elongated fiber stream 132 may be cooled ambiently before collection on belt or drum collector 134 as a web 136. System 100 may comprise a plurality of dies 102 disposed to sequentially deposited layers of melt blown thermoplastic fibers of different sizes to be collected as a non-woven web on collector 134.

Figure 3:
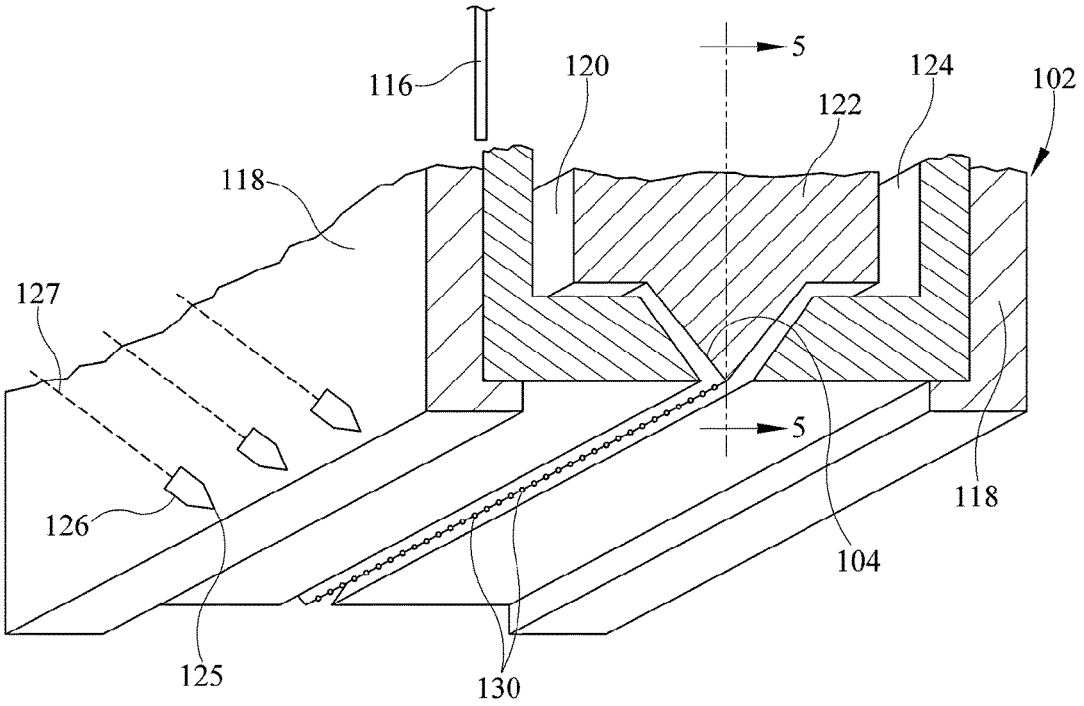
FIG. 3 is lower perspective view of the die and spray nozzles of FIG. 1.

FIG. 3 shows a lower perspective view of die 102. With reference to FIGS. 2 and 3, it is shown that die 102 may comprise a longitudinally extending die nose or die tip 104 having a plurality of spinnerets 130 substantially equidistantly spaced from each other configured to axially attenuate the melted polymer 132 therefrom. A longitudinal fluid material flow through passage 120 and 124 is disposed along each longitudinal side of die tip 104 configured to axially attenuate the melted polymer from die tip 104 in fibrous form. Insulating material 118 is disposed along each longitudinal side of die tip 104.

A plurality of liquid spray nozzles 126 are configured and disposed to spray a liquid into the fibrous melted polymer attenuated from die tip 104. Each liquid spray nozzle 126 has an outlet 125 in fluid communication with a fluid source, not shown, through fluid conduit 127. In at least one embodiment, system 100 has a ratio of spinnerets 130 to spray nozzles 126 of about 135:1. For example, die tip 104 may have about thirty spinnerets 130 per inch and spray nozzles 126 may be spaced about four and a half inches apart. Spray nozzles 126 may be configured to spray water alone, water with additives, or other liquid that provides desired interaction with fiber stream 132 to form fibrous material 136, shown in FIG. 1, having a desired beta crystalline content.

Spray nozzles 126 may be configured to atomize the liquid into very small droplets and form a fog or mist about fiber stream 132. In at least one embodiment, spray nozzles 126 are configured to spray a liquid therefrom 128 to impinge fiber stream 132 and not cause any substantial change in the flow of fiber stream 132. In this embodiment, spray nozzles 126 are configured to spray a liquid 128 at a droplet size and velocity to provide no change, almost no change, or a negligible change in the flow parameters of fiber stream 132. For example, spray nozzles 126 may be configured to spray a liquid therefrom 128 in droplet size having a diameter of less than 150 μm.

Figure 4:
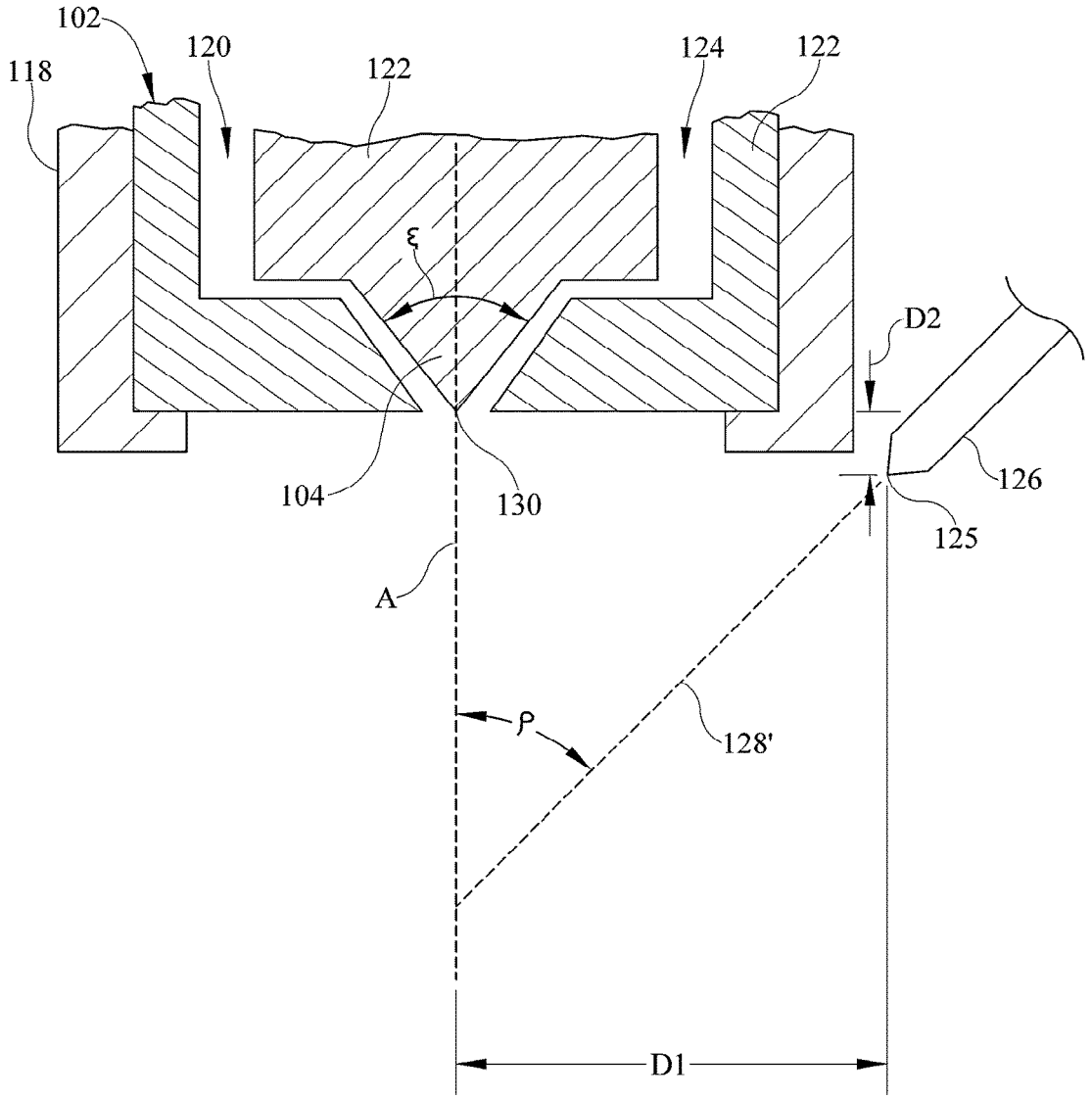
FIG. 4 is a cross-sectional view of a portion of the die of FIG. 1 showing the disposition of the spray nozzles with respect to the spinneret.

FIG. 4 shows a cross-sectional view of die 102 and the disposition of the spray nozzles 126 with respect to die body 122. A plurality of liquid spray nozzles 126 may be configured and disposed to spray a liquid into the fibrous melted polymer attenuated from die tip 104 and spinneret 130 in axial direction "A". Die body 122 may have a triangular cross-sectional portion forming a die nose configuration 104 with a pair of oppositely directed attenuating hot air stream flow through passages 120 and 124 being directed along die nose 104 flanks toward centrally emitted melt blown fibers 132, attenuated through spinnerets 130, with the hot air streams flowing in opposed angular direction so as to include an angle n therebetween. Other hot fluids or gasses may be flowed through hot air stream flow through passages 120 and 124 for attenuating melt blown fibers 132. The angle ϵ between attenuating hot air stream flow through passages 120 and 124 may be in a range of thirty (30) to ninety (90) degrees.

In at least one embodiment, each liquid spray nozzle has an outlet 125 configured and disposed to spray a substantial amount of liquid 128' at an angle ρ between about 20° and about 85° toward the attenuation axis "A" of die tip 104. In at least one other embodiment, each liquid spray nozzle has an outlet 125 configured and disposed to spray a substantial amount of liquid 128' at an angle ρ of about 40', toward the attenuation axis "A" of die tip 104. In at least one additional embodiment, system 100 has a plurality of spray nozzles configured to spray at least about 280 cc/min liquid toward attenuation axis "A" of die tip 104. In at least one further embodiment, each liquid spray nozzle has an outlet 125 axially spaced D2 at most about 7 mm from die tip 104. In at least one further embodiment, each liquid spray nozzle has an outlet 125 laterally spaced, D1, at most about 120 mm (depending on the size of the die) from attenuation axis "A" of die tip 104.

System 100 may have each liquid spray nozzle 126 disposed to spray liquid at a common direction toward attenuation axis "A" of die tip 104. For example, each liquid spray nozzle 126 may be disposed on the same of die 102 as shown in the figures. However, it is to be understood that an embodiment of the present disclosure may have spray nozzles 126 disposed on both longitudinal sides of die 102. In at least one embodiment of the present disclosure, each liquid spray nozzle 126 is configured and disposed spray liquid at an angle ρ and at a volumetric flow rate sufficient to increase a meltblowing production rate of fibrous material. In at least one additional embodiment of the present disclosure, each liquid spray nozzle 126 is configured and disposed spray liquid at an angle ρ and at a volumetric flow rate sufficient to minimize the disturbance of melted polymer being attenuated the from a die tip 104.

In at least one embodiment, system 100 may be configured for meltblowing polymer into a fibrous material wherein each liquid spray nozzle 126 has its outlet 125 configured and disposed to spray a substantial amount of liquid 128' at an angle ρ between about 20° and about 85° toward attenuation axis "A" of die tip 104. In at least one additional embodiment, system 100 may be configured for meltblowing polymer into a fibrous material wherein each liquid spray nozzle 126 has its outlet 125 configured and disposed to spray a substantial amount of liquid 128' at an angle ρ of about 40° toward the attenuation axis of the die tip. As used herein, substantial amount of liquid 128' means more liquid follows a centralized direction than other directions or an average direction, as indicated by dashed line 128'. For example, each liquid spray nozzle 126 may be configured to spray a conical liquid stream as designated by 128 in FIG. 1. Substantial amount of liquid 128' may be a central axis of the conical liquid stream 128. In at least one further embodiment, system 100 is configured for meltblowing polymer into a fibrous wherein each liquid spray nozzle 126 is configured to spray a liquid therefrom in droplet form having a diameter of less than 150 μm.

Figure 5:
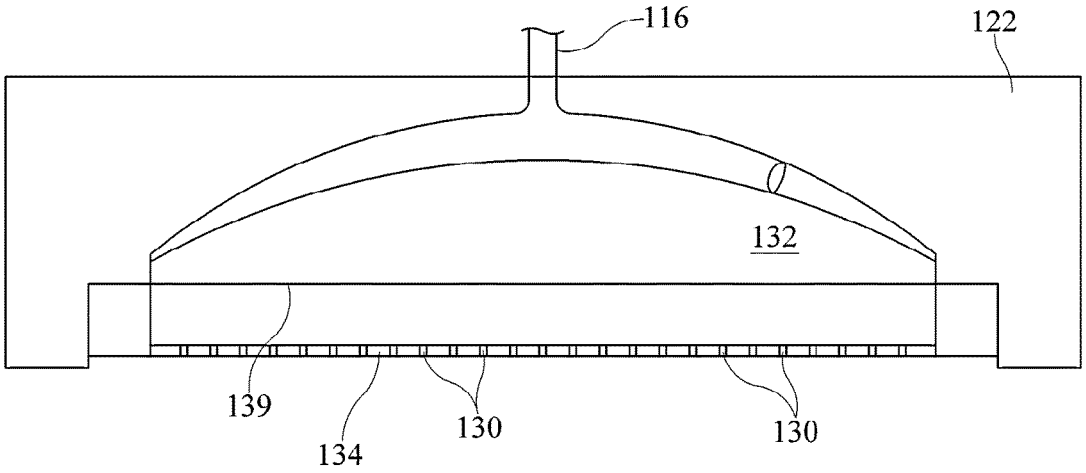
FIG. 5 is a cross-sectional view taken in a plane through line 5-5 of FIG. 3 showing an embodiment of a melted polymer flow through structure in the die of FIG. 1.

FIG. 5 shows a cross-sectional view taken in a plane through line 5-5 of FIG. 3 showing an example embodiment of a welted polymer flow through structure. As can be seen in FIG. 5 of the drawings, the cross-section of longitudinally extending slot type fluid material flow-through passages 132 is formed in unitary die body 122 in a hanger type shape, such a hanger-type shape for fluid material passages of uniform velocity being long known in the art. As aforedescribed elongated, slotted passages 132 communicate with nose sections 139 and may be removably mounted in a stepped recess die body 122. Formed in an apex portion of nose section 139, also in a manner known in the art, is an spinneret plate 134. Each spinneret plate 134 includes at least one row of spaced fibrous fluid emitting spinnerets 130 therein. In accordance with still another feature of the present invention, these spaced apertures advantageously number approximately thirty (30) per inch, each being sized and geometrically shaped to provide a desired size and cross-sectional shape of the melted polymer material passing therethrough. It is to be understood that other and different flow-through die body 122 passages, as known by persons having ordinary skill in the art, may be incorporated in die body 122 and are within the scope of the present disclosure.

System 100 of present disclosure may provide a process for forming a web of fibrous filter media. System 100 of the present disclosure may also provide a process of forming a layered web of fibrous filter media wherein adjacently facing layers of fibrous filter media which may bond or be distinctly separate from each other. For example, system 100 may comprise two or more dies 102, disposed in parallel with each other, and a process of the present disclosure may comprise sequentially feeding filter media fibers in heated and fiber attenuated form from heated melt blown die source spinnerets 130, from each die 102, toward a spaced collector source 134 to be layered. Each layer may adhere to one another or each layer may be separate and distinct layers of fibrous filter media collected on collector source 134 with one fibrous filter media layer being on top of the other in faced relation. An example system of present disclosure configured for providing layered fibrous media is further disclosed in U.S. Pat. No. 5,891,482, entitled "Melt Blowing Apparatus for Producing A Layered Filter Media Web Product", by Kyung-Ju Choi, issued Apr. 6, 1999, which is hereby incorporated by reference.

The present disclosure also provides selected angles for fiber attenuating fluid streams wherein such attenuating fluid streams 120 and 124 on either side of a fluid material stream 132, flowing along axis "A", are more in opposition to each other to provide a high velocity, turbulent, pulse-like sinusoidal flow from the fluid material outlet to increase the rate of fiber attenuation. A pair of fluid attenuating passages 120 and 124 may be disposed at an opposed angle ϵ therebetween to define an angle of about 30° to about 90° , about 90° , in excess of 90° , or in excess of approximately 95° so that the fluid attenuating outlet pairs are so angularly positioned relative each of the fluid material outlets to be more in opposition to each other to provide a high velocity, turbulent, pulse-like sinusoidal attenuated fibrous flow from each of the fluid material outlets to thus increase the rate of fibrous layer attenuation. Die 102 may comprise a heater, not shown, or be in heat communication with a heater whereby heat is conducted to the fluid material passages 120 and 124 and the fluid attenuating passages or spinnerets 130. An insulating means or insulator 118 may be cooperative with the heater to appropriately insulate portions of the heater as well as die body 122.

It is to be understood that various changes can be made by one skilled in the art in one or more of the process steps and in one or more of the several parts of the die apparatus and resulting product without departing from the scope or spirit of the present disclosure.

In at least one embodiment of the present disclosure a process for Alpha to Beta transition by water spraying during the filament formation is provided. The use of water spray during the fiber formation process right below spinneret die 102 may improve the nonwoven web tensile stresses and the percent elongation to break. It is found that alpha to beta phase transition may occur due to a rapid quenching of the molten polypropylene filaments by the water spray. The presence of high levels of beta crystals may improve the impact strength, toughness, micro-pores and/or heat deflection temperature. For example, commercial isotactic alpha PP has a melting point ranging from 160 to 166° C., depending on crystallinity (atactic contents) while beta PP and syndiotactic PP with a crystallinity of 30% have a melting point of 150° C. and 130° C., respectively. The density of gamma crystal is higher than alpha or beta crystals.

EXAMPLES

Example 1

A melt blowing system, schematically shown as system 100 shown in FIG. 1 was used. System 100 provides a melt blowing process for producing fine fibrous nonwoven webs directly from polymer melts using high-velocity hot air to attenuate the filaments. This process is unique because it is used almost exclusively to produce microfibers rather than fibers the size of normal textile fibers. Meltblown microfibers generally have diameters in the range of 2 to 4 μm, although they may be as small as 0.1 μm and as large as 10 to 15 μm. It is soft and may provide good filtration characteristics. The melt blown process is a one-step process in which high-velocity hot air blows a molten thermoplastic resin from an extruder die tip onto a round drum collector or a conveyor belt to the take-up devices such as a winder. It is a self-fuse bonding web. This process comprises an extruder, die assembly, web formation, and winding as shown in FIG. 1. Polypropylene is widely used and easy to draw into fibers.

Commercial high melt flow rate polypropylene was used. Sample webs were prepared with and without water spray under the same process conditions, using a system schematically shown as system 100 in FIG. 1. Water at the room temperature was sprayed 40° to the direction of fiber formation near the spinneret die exit. Tensile and percent elongation to break were measured by Shimadzu Model AGS-50G (average out of 5 good measurements).

The WAXS (Wide Angle X-ray Scattering) scan experiment was carried out with PANalytical X-ray Diffraction Equipment at the Jeonnam National University in South Korea. Mettler DSC (Differential Scanning calorimetry) at the Jeonnam National University in South Korea was used to obtain thermal properties of sample webs.

PP was melt blown using system 100 with operating conditions of:

Extruder: 240° C., Screw RPM: 30

Die: 240° C.

Air manifold: 300° C.

Water spray: 280 cc/min

FIG. 6 shows melting behavior of sample webs with (O) and without (X) water spray. As shown in FIG. 6, the peak melting temperatures of the sample webs without water spray and with water spray were 165.3° C., and 161.9° C., respectively. The melting temperature of the sample web without water spray is slightly higher than that of the sample web with water spray. The crystallinities based on the heat of fusion of the sample webs without water spray and with water spray were 43% and 47%, respectively (100% crystalline PP=191.3 J/g). The crystallinity of the sample web with water spray is higher than that without water spray. It shows that the use of water spray enhances the crystallization of polypropylene during the fiber formation from the melt. The slight reduction in melting temperature from 165.3° C. to 161.9° C. may be related to crystal transformation from α-form to β-form (melting temperature of 100% β-form: 150° C.).

FIG. 7 graphically shows the WAXS (Wide Angle X-ray Scattering) intensity against 2θ scan for the sample webs with and without water spray. It appears that the crystallinity of the sample web without water spray seems much higher that of the sample web with water spray. However, the WAXS (Wide Angle X-ray Scattering) intensity of a sample web with water spray may be combination of α-form and β-form.

FIG. 8 graphically shows WAXS 2θ scan of sample webs with and without water spray along with 2θ scan of PP-β form. The α-form is a monoclinic with a=0.661 to 0.666 nm, b=2.073 to 2.098 nm, c=0.647 to 0.653 nm and the angle, β=98.5 to 99.62°. The typical reflection planes of α-form are (110), (040), (130), (111), (131) and (041). The β-form is a hexagonal with a=b=1.101 nm, c=0.649 nm with the typical reflection planes of (300) and (301). It is clear that the WAXS pattern of sample without water spray shows a typical α-form with distinct peaks of (110), (040), (130), (111), (131) and (041) planes.

The WAXS pattern of low crystalline β-form was added in FIG. 8. When the intensity of β-form added to the intensity of a sample web without water spray (α-form) at each corresponding 2θ angle will be close to the intensity of a sample web with water spray. It indicates in a transition phase toward β-form. Therefore, the melting temperature may decrease with increasing β-crystal content as observed above in FIG. 6.

FIG. 9 graphically shows tensile stresses of sample webs along the machine direction and the transverse direction. The tensile property along both machine (MD) and transverse directions (TD) of a sample web with water spray is better than that without water spray.

FIG. 10 graphically shows percent elongation to break of sample webs along the machine direction (MD) and the transverse direction (TD). The percent elongation to break along both machine (MD) and transverse directions (TD) of a sample web with water spray is much better than that without water spray. The percent elongation to break is a very important mechanical property because it is closely related to the impact strength and toughness.

As shown herein, the crystallinity increases by the use of water spray right below the spinneret die exit indicating the enhancement of the crystallization of polypropylene during the fiber formation from the melt. The peak melting temperature of the sample web without water spray is slightly higher than that of the sample web with water spray. The WAXS pattern of a sample web without water spray shows a typical α-form while a sample web with water spray appears to be in a transition phase toward β-form. DSC results also support this transition. The tensile stress and percent elongation to break along both MD and TD of a sample web with water spray is shown to better than that without water spray.

Tensile Stress data is shown in Table 1 and Elongation to Break data is shown in Table 2. Wherein: With: water spray, Without: no water spray, MD: Machine Direction, TD: Transverse Direction.

TABLE 1

| | % Elongation to Break |
|---|---|
| With - MD | 38 |
| Without - MD | 18 |
| With - TD | 50 |
| Without - TD | 23 |

TABLE 2

| | Tensile Stress (MPa) |
|---|---|
| With - MD | 16.5 |
| Without - MD | 12.3 |
| With - TD | 14.3 |
| Without - TD | 9.4 |

As shown in Table 1, both MD and TD exhibited greater than 100% increase in the % elongation to break with water spray according the presently disclosed process and system. As shown in Table 2, MD exhibited greater than 30% increase, or about a 34% increase, in the Tensile Stress (MPa) with water spray and TD exhibited greater than 50% increase, or about a 52% increase, in the Tensile Stress (MPa) with water spray according the presently disclosed process and system.

Example 2

Two samples of PP were melt blown using system 100 and the operating conditions of Example 1 with the exception that the X-ray diffraction was carried out at University of Louisville. The PP was blended with other materials and melted in the extruder. The blends of samples 1 and 2 comprised:

Sample 1: 2% Hindered Ar pine Light Stabilizers (HALS) 1+98% Polypropylene HALS 1: Mayzo BLS 1770

Sample 2: 3% HALS 2+0.5% Multifunctional phenolic antioxidant+96.5% Polypropylene.

HALS 2: BASF Uvinul 5050

Multifuctional phenolic antioxidant: BASF Irganox 1425 WL

FIGS. 11 through 13 show the effects of blending PP with HALS and/or antioxidant in at least one embodiment of the presently disclosed system configured to spray water into attenuating fibers. FIG. 11 shows the WAXS (Wide Angle X-ray Scattering) intensity against 2θ scan for four sample webs—pure PP with and without water spray, sample 1 with water spray and sample 2 with water spray. When comparing with the beta crystal (300) peak (2θ=16.2) shown in FIG. 11, the maximum peak for both samples 1 and 2 with water spray shifted much closer to the beta crystal (300) peak. This may show that HALS without and with antioxidant additive may help to increase beta crystal contents.

FIGS. 12 and 13 show the mechanical properties such as the tensile stress in MPa and percent elongation to break. With water spray, the tensile stress is shown to increase with blending of HALS with PP. The percent elongation to break is shown to increase for both sample 1 and 2 with water spray. This percent elongation to break may be closely related to impact strength and toughness.

The WAXS patterns of sample webs with both samples 1 and 2 with water spray show the maximum peak shifting much closer to the beta crystal (300) peak indicating increased amount of beta crystals. Therefore, HALS may improve rate of the alpha to beta transition.

The tensile stress is shown to increase with the blending of HALS and the percent elongation to break is shown to increase for both samples 1 and 2 with the comparison of the water spray samples with and without HALS. This shows that the blending of HALS with PP and attenuating fibers with water spray may enhance and increase the beta contents. It also shown that blending both HALS and the antioxidant with the PP may further improve the beta contents.

Alpha to Beta transition by water spraying during the filament formation is shown herein. The presence of high levels of the beta crystals may improve the impact strength, toughness, micro-pores and heat deflection temperature. HALS are used in polymer processing in order to protect the polypropylene fibers from UV lights. Antioxidants are used to improve thermal stability of polypropylene. Therefore, aspects of the present disclosure may improve UV light stability and/or thermal stabilities. Additionally, blending HALS with PP may increase beta crystal content of fibrous web formed with the presently disclosed system and process.

The invention claimed is:

1. A process for meltblowing polymer into a fibrous material having high beta crystalline content, the process comprising the steps of:

extruding and moving melted polymer to a meltblowing die;

receiving the melted polymer from the extruder with a plurality of longitudinally extending die tips, each die tip having a spinneret;

attenuating melted polymer axially from the plurality of spinnerets;

flowing hot air through longitudinal fluid material flow through passages disposed along each longitudinal side of each die tip, contacting the melted polymer at the spinneret polymer outlet, and axially attenuating the melted polymer from each spinneret in fibrous form;

spraying a liquid into the fibrous melted polymer immediately upon being attenuated from each die tip wherein a substantial amount of liquid being sprayed is at an angle between about 20° and about 85° toward the attenuation axis of the die tip; and collecting the fibers attenuated from each spinneret.

2. The process for meltblowing polymer into a fibrous material having high beta crystalline content of claim 1 wherein the step of spraying a liquid comprises spraying at least about 280 cc/min liquid toward the attenuation axis of each die tip.

3. The process of claim 1 wherein the step of spraying a liquid into the fibrous melted polymer attenuated from each die tip comprises spraying the liquid at a common direction toward the attenuation axis of each die tip.

4. The process of claim 1 wherein the step of spraying a liquid into the fibrous melted polymer attenuated from each die tip comprises spraying the substantial amount of the liquid at an angle of about 40° toward the attenuation axis of each die tip.

5. The process of claim 1 wherein the step of spraying a liquid into the fibrous melted polymer attenuated from each die tip comprises spraying the liquid in droplet form wherein the droplets have a diameter of less than 150 μm.

6. The process of claim 5 wherein the step of collecting the fibers attenuated from each spinneret comprises collecting the fibers having at least a 100% increase in a percent elongation to break in both a machine direction and a transverse direction as compared to a process void of the step of spraying a liquid into the fibrous melted polymer attenuated from each die tip.

7. The process of claim 5 wherein the step of collecting the fibers attenuated from each spinneret comprises collecting the fibers having at least a 50% increase in tensile stress in a transverse direction and at least a 30% increase in tensile stress in a machine direction as compared to a process void of the step of spraying a liquid into the fibrous melted polymer attenuated from each die tip.

8. The process for meltblowing polymer into a fibrous material having high beta crystalline content of claim 1 further comprising a step of blending a Hindered Amine Light Stabilizer with the polymer.

9. The process for meltblowing polymer into a fibrous material having high beta crystalline content of claim 1 further comprising a step of blending a Hindered Amine Light Stabilizer and an antioxidant with the polymer.

10. The process for meltblowing polymer into a fibrous material having high beta crystalline content of claim 1 further comprising a step of blending a Hindered Amine Light Stabilizer with the polymer, wherein the collected fibers form a web having a greater elongation to break than the process void of the step of blending a Hindered Amine Light Stabilizer with the polymer.

11. The process for meltblowing polymer into a fibrous material having high beta crystalline content of claim 1 further comprising a step of blending a Hindered Amine Light Stabilizer and an antioxidant with the polymer, wherein the collected fibers form a web having a greater elongation to break than the process void of the step of step of blending a Hindered Amine Light Stabilizer and an antioxidant with the polymer.

* * * * *